United States Patent [19]

Baughman

[11] Patent Number: 4,588,103

[45] Date of Patent: May 13, 1986

[54] CLOSURE CONSTRUCTION HAVING BACK-UP SUPPORT MEANS

[75] Inventor: Gary M. Baughman, Auburn, Ind.

[73] Assignee: Rieke Corporation, Auburn, Ind.

[21] Appl. No.: 777,407

[22] Filed: Sep. 18, 1985

[51] Int. Cl.[4] ..... B65D 41/04

[52] U.S. Cl. ..... 220/288; 285/304

[58] Field of Search ..... 220/288, 304; 285/203, 285/204, 382.4; 29/512, 523; 222/569, 570

[56] References Cited

U.S. PATENT DOCUMENTS

| | | | |
|---|---|---|---|
| 4,078,696 | 3/1978 | Crisci | 220/308 |
| 4,087,019 | 5/1978 | Yamazaki | 220/258 |
| 4,109,600 | 8/1978 | Post | 285/221 |
| 4,114,779 | 9/1978 | Stoll, III | 220/288 |
| 4,135,639 | 1/1979 | Dillion | 220/288 |
| 4,164,304 | 8/1979 | Roberson | 220/288 |
| 4,195,750 | 4/1980 | Fee | 220/288 |
| 4,231,488 | 11/1980 | Ward et al. | 220/288 |
| 4,252,246 | 2/1981 | Johnson et al. | 220/288 |
| 4,294,382 | 10/1981 | Summers et al. | 222/529 |
| 4,316,318 | 2/1982 | Mineo | 285/204 |
| 4,418,832 | 12/1983 | Schneider | 220/288 |

*Primary Examiner*—George T. Hall

*Attorney, Agent, or Firm*—Woodard, Weikart, Emhardt & Naughton

[57] ABSTRACT

A closure and boss combination for providing an internally threaded outlet in a drum end includes a raised metal boss formed in the drum end and configured with a pair of concentric axially extending annular walls connected by an annular ring-shaped top surface. Securely crimped within the raised metal boss is a synthetic material closure which includes an internal series of threads surrounded by a crimping flange which includes on its outer diameter surface a series of serrations configured with alternating recesses and protruding portions. The flange includes an interior support surface which is substantially concentric with the outer surface of the serrations and the inner, axially extending wall portion of the boss is contiguous with this inner support surface in order to provide back-up support and preclude close-in of the closure and distortion of the closure threads during the crimping operation and during subsequent stress-inducing operations such as exposure to high-temperature sources.

11 Claims, 5 Drawing Figures

CLOSURE CONSTRUCTION HAVING BACK-UP SUPPORT MEANS

BACKGROUND OF THE INVENTION

The present invention relates in general to synthetic material closures for use in providing an internally threaded opening in a container end. More particularly, the present invention relates to the use of a portion of the container (drum) end as a back-up support for the closure (1) during the crimping operation locking the closure into the container end and (2) thereafter as the closure is subjected to various stresses.

The concept of providing a plug or a closure in combination with a metal container end is disclosed in a number of prior references. In some cases, the closure is internally threaded and in some cases the closure is fabricated out of a synthetic material, such as plastic. In the majority of these prior references, the drum end is formed with a raised and circular boss, of varying configurations, which is utilized for securing or anchoring the closure in place. In some of these prior references, the closure orientation may be of concern and in others, additional components are necessitated in order to complete the assembly.

Some examples of these foregoing types of closures and closure/drum combinations are provided by the following patent references and to that degree these references are relevant to the present invention.

| U.S. Pat. No. | Patentee |
|---|---|
| 4,195,750 | Fee |
| 4,135,639 | Dillon |
| 4,316,318 | Mineo |
| 4,231,488 | Ward |
| 4,252,246 | Johnson |
| 4,087,019 | Yamazaki |
| 4,418,832 | Schneider |
| 4,164,304 | Roberson |
| 4,114,779 | Stoll, III |
| 4,109,600 | Post |
| 4,078,696 | Crisci |

Fee discloses a flange for a container opening which has an internally threaded aperture to receive a plug, and a plurality of external serrations in a circularly spaced-apart relationship around the periphery of the upper portion of the flange. A container suitable for the flange has a boss around the container opening in a wall (usually the end wall) of the container and the boss is formed with internal serrations equal in number to the number of external serrations on the flange. The plug is removable from the flange when access to the contents of the container is desired.

Dillon discloses a closure construction for a container, such as a steel drum, which includes a flange member having an internally threaded opening adapted to be closed by an externally threaded cap. The flange member includes an integral flange portion that is firmly secured in an offset portion of the container wall by means of spaced protuberances at the outer edge of the flange portion that are tightly engaged by the offset portion of the container wall.

Mineo discloses a method of mounting a mouthpiece onto a container which comprises fitting a tubular mouthpiece having an externally threaded portion and an annular leg portion of reduced thickness at the lower portion of the externally threaded portion, around an upright tubular portion formed integral with the top plate of the container, bending the upper end of the tubular portion outward to cause the bent edge of the upper end to hold the upper end of the mouthpiece from above and pressing outward from inside the lower end of the tubular portion to form a plurality of projections at the lower end of the tubular portion.

Ward discloses a container closure spout construction for incorporation into a metal drum container and including a container wall portion having a spout aperture, and a closure spout member having a peripheral substantially transversely extending flange portion and, preferably integral therewith, an intermediate substantially axially extending tubular portion defining a closure spout opening within the flange portion and adapted to removably receive a cooperating closure element such as a plug or cap.

Johnson discloses a fuel tank cap assembly which includes a closure, a cover, and a skirt. Each of these component parts is of an injection-molded construction with the cover and skirt having interlocking portions which cooperate to maintain the cap assembled with a portion of the closure secured between the cover and the skirt.

Yamazaki discloses a two-part plug arrangement for a container which includes an outer plug of soft resilient material and a mating inner plug of deformable material. The inner plug is seated within the outer plug, and the mating plugs are together seated within an opening of a wall of the container. Such opening has an annular turn-over wall along its circumference, and the outer plug has an annular flange adapted to engage such turn-over wall.

Schneider discloses a container which is provided with an annular support flange which can be flat or rise inward in a frustum-defining manner. The flange is connected to the container contents-containing base portion in the vicinity of the lower edge of the cover when in the seated position. The support flange is used for supporting the fingers during removal of the cover.

Roberson discloses a drum having a blow-molded liner wherein the liner has a neck which extends through an opening formed in a wall of the drum. The closure assembly is provided for association with the neck both to retain the neck relative to the drum and to close the neck. The closure assembly includes a retainer and a closure member, the retainer including inner and outer concentric walls joined in spaced relation by a bridging portion. The neck is threadedly engaged with the outer wall and is received between the two walls with a terminal portion of the neck being wedgedly formed to assure a seal between the retainer and the neck.

Stoll III discloses an improved closure assembly for plastic drums which includes female buttress threads formed on a tubular projection of the drum head and an adaptor inserted into the tubular projection threadedly engaging the buttress threads. The adaptor includes internal standard pipe threads which are adapted to receive standard pipe-threaded members, such as dispensing valves, pump fittings, as well as standard bung plugs. Means are also provided for sealingly isolating the buttress thread inter-engagement to prevent product accumulation therebetween.

Post discloses a process of applying a threaded seat for connecting a closing means or operations means to a metal plate, such as the wall of a drum, by making a hole in the plate and by drawing a cylindrical collar from the periphery around the hole approximately at a right angle to the plane of the plate, whereafter a thread is made in the part drawn from the plane of the plate wherein a thread is provided in the collar between of the plate and the end edge of the collar.

Crisci discloses a closure and container in which the closure has an axial flange which cooperates with the container to lock the closure in closed position. The closure also includes an annular recess accommodating a resilient seal for sealing against the container rim. The seal projects from the recess before assembly of the closure to the container.

The foregoing references generally address ways to solve or improve upon concerns of assembly, loosening or rotation of the closure and leakage of the container contents through or around the container. Admittedly, a number of secondary concerns are also addressed, such as a concern over closure distortion which is presented by the Dillon patent.

In Dillon, mention is made of the substantial lateral and radial forces associated with securing the closure into the container end. The concern expressed is in regard to the accuracy of closure threads and the ability of these threads to easily receive the threaded closure cap or plug. The Dillon approach to solving this concern is by means of a fairly complex structuring of the closure and container end. FIGS. 2–7 generally disclose this complexity and the point to understand with regard to the present invention is that Dillon does not utilize any portion of the container end as an internal, back-up support member or means for the closure.

The present invention also addresses a concern regarding distortion of the closure threads which may occur during the crimping operation or which may occur at other times when the closure is exposed to stresses such as exposure to high temperature during a paint-curing cycle. During the crimping operation, the synthetic material closure and its internal threads are exposed to substantial forces which tend to distort the threads and close-in the closure. The present invention achieves a reduction or conceivably elimination of such distortion and close-in by forming the raised boss of the container end with a downwardly extending axial portion that serves as back-up support for the closure not only during the crimping operation, but thereafter as the closure is subjected to stresses.

One option to the foregoing approach of the present invention is to use an extremely strong (high-strength) plastic wherein the material properties of that plastic based upon the size of the closure are sufficient to resist any close-in or distortion which might otherwise be caused by the crimping forces. In other words, if a material can be selected for the closure which will not yield to the level of forces created during the crimping operation, then the necessity for a back-up or support means is obviated. The drawback of this alternative approach is the higher material costs and thus a higher overall cost for the closure. By utilizing the container end boss as a back-up support, the plastic flange is supported by the metal of the drum end rather than relying solely on the compressive strength of the plastic flange to prevent close-in and thread distortion.

A higher-strength and more-expensive synthetic material for such a closure might include a nylon base material with 50 percent glass. A weaker, but less-expensive, synthetic material might include the same nylon base material with only 20 percent glass and 30 percent fillers.

One advantage of the present invention over prior devices which may incorporate a retaining ring as a securing means is the elimination of one component part. Elimination of such part results in not only a cost savings for the overall closure, but one less item which has to be ordered, stocked, assembled and replaced contributes to an improved product. An example of such a retaining ring concept wherein the ring has an interior portion for clamping the closure to the container boss is in U.S. Pat. No. 4,294,382 issued Oct. 13, 1981 to Summers et al.

SUMMARY OF THE INVENTION

A closure and container combination for providing a threaded outlet in a container end according to one embodiment of the present invention comprises in combination, a container end having a raised boss formed therein, the raised boss including an outer axially extending wall portion, an inner axial extending wall portion and a radially extending wall portion joining the inner and outer wall portions together and a synthetic material closure received by the container raised boss and having plug engaging means internally disposed therein and an annular crimping flange including a first flange surface contiguous with the outer wall portion and a second flange surface contiguous with the inner wall portion.

One object of the present invention is to provide an improved synthetic material closure and container boss combination.

Related objects and advantages of the present invention will be apparent from the following description.

DESCRIPTION OF THE PREFERRED EMBODIMENT

Figure 1:
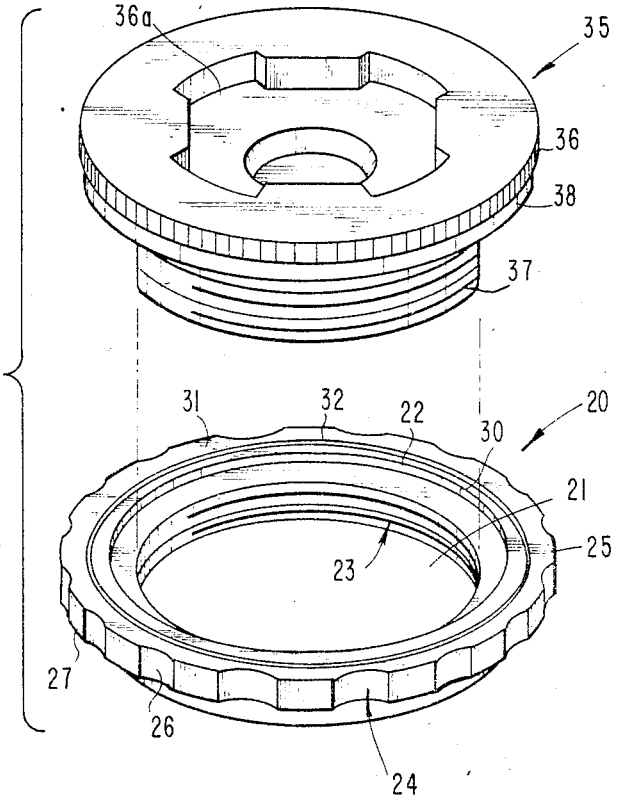
FIG. 1 is a perspective view, in exploded form, of a closure according to a typical embodiment of the present invention and its cooperating plug.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a closure 20 which is fabricated as a homogeneous, unitary member from a synthetic material, which in the exemplary embodiment is a nylon base material having approximately 20 percent glass and 30 percent fillers.

Closure 20 is generally cylindrical and defines on its interior a hollow passageway 21 which is bounded by an inner wall 22 which includes a series of threads 23 formed therein. The body of closure 20 includes an upper and outwardly extending securing flange 24 which includes an outer lip portion 25 which is configured with an annular series of serrations comprising an alternating series of recesses 26 and protruding portions 27.

Securing flange 24 includes an outer clamping surface which is coincident with the outer surfaces of the recesses and protruding portions and an inner securing wall 30 which is disposed in a generally concentric manner with the recesses and protruding portions. Inner securing wall 30 and is located above the series of threads 23 and outward of the threads in a generally concentric manner with the threads. Inner securing wall 30 is generally circular and axially extending and securing flange 24 includes a top surface portion 31 which is radially extending between the top edge of inner securing wall 30 and the top edge of recesses 26 and protruding portions 27. Disposed in a circular fashion on surface portion 31 is a sealing bead which is flexible and compressible and provides a liquid-tight interface between surface portion 31 and the drum end boss into which closure 20 is installed.

Figure 3:
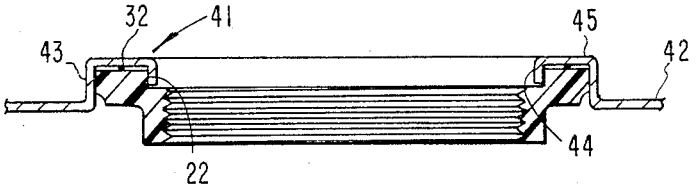
FIG. 3 is a front elevation view in full section of the FIG. 1 closure and FIG. 2 raised boss as assembled.

Also illustrated as part of FIG. 1 in an exploded view approach is a closure plug 35. Closure plug 35 is molded as a homogeneous, unitary member from a synthetic material. Closure plug 35 includes a top portion 36 and external threads 37 which are designed and arranged as to diameter and pitch so as to be engageable with and received by the series of internal threads 23 which are fabricated as part of closure 20. The upper surface of top portion 36 is provided with a socket-type recess for either manual or automated installation and removal of closure plug 35. As is to be understood and as will be described in greater detail hereinafter, although external threads 37 engage with threads 23, the underside of top portion 36 does not lay directly against surface portion 31. As is best illustrated in FIG. 3, a portion of the metal drum end boss is disposed across surface portion 31 and upon the threaded engagement of plug 35 with closure 20, the undersurface of top portion 36 is drawn into contact except when a seal is present with the top surface of the metal boss.

In the exemplary embodiment, a rubber gasket (seal) 38 of an annular ring configuration is disposed directly beneath top portion 36. This seal provides a liquid-tight interface between the closure plug and the top surface of the metal boss. As a result, the contents of the container with which closure 20 and closure plug 35 are used are completely sealed at every point of possible leakage.

Figure 2:
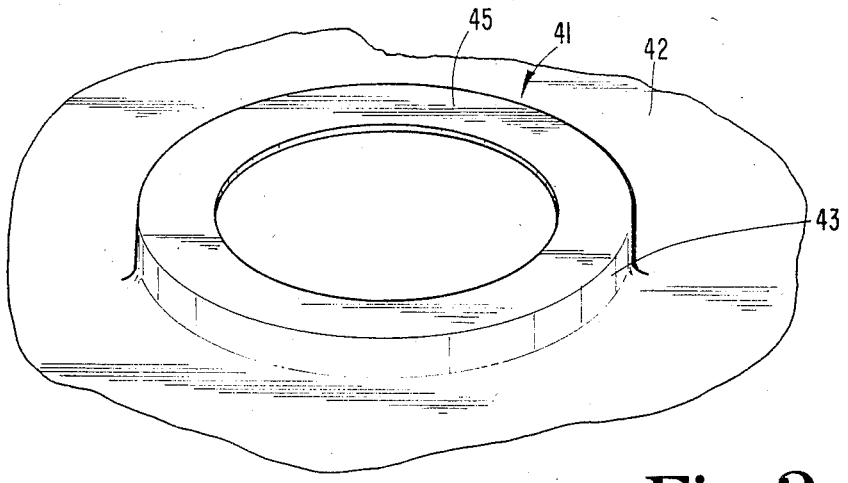
FIG. 2 is a perspective view of a drum end annular boss designed to receive the FIG. 1 closure according to a typical embodiment of the present invention.

Referring to FIG. 2, there is illustrated a generally cylindrical, raised metal boss 41 which has been formed in a drum (container) end 42. Boss 41 includes an axially extending outer wall 43, a radially extending upper wall 45, and ultimately an axially extending inner wall 44 (see FIGS. 3-5). The initial forming of boss 41 provides only outer wall 43 and a horizontal portion, the inner margin of which is later formed into inner wall 44. As will be understood by referring to FIG. 3, outer and inner walls 43 and 44 are substantially concentric with one another and these walls are substantially parallel to one another in any cutting plane extending through boss 41. Upper wall 45 which extends between the upper edge of wall 43 and the upper edge of wall 44 is of an annular ring shape and in any cutting plane extending through boss 41, upper wall 45 is substantially perpendicular to inner wall 44 and outer wall 43. It is also to be understood that inner wall 44 does not extend axially the same distance which outer wall 43 extends. This dimensional relationship can best be understood by reference to FIGS. 3 wherein the arrangement of boss 41 relative to closure 20 is illustrated. Due to the differing axial heights of the outer surface of securing flange 24 and the inner securing wall 30, the corresponding inner and outer walls of the boss are dimensioned in a cooperative manner.

Figure 4:
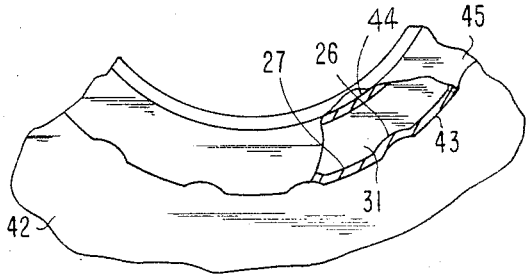
FIG. 4 is a partial, fragmentary top plan view of the serration engagement between the FIG. 1 closure and the FIG. 2 boss according to a typical embodiment of the present invention.
Figure 5:
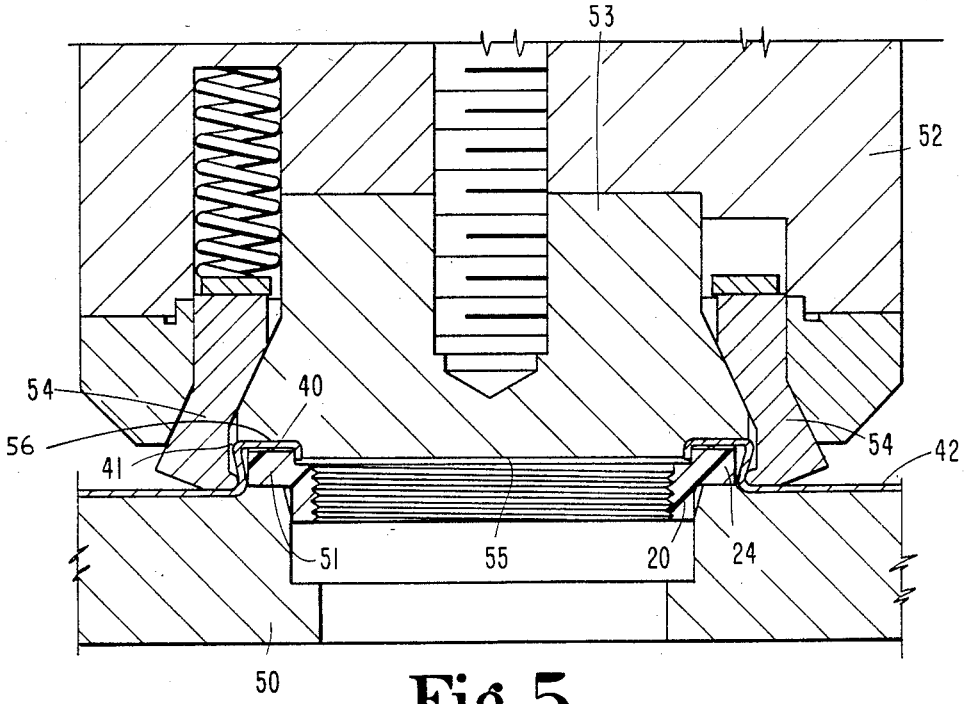
FIG. 5 is a front elevation view in full section of the FIG. 1 closure and FIG. 2 boss as loaded in a boss crimping machine.

Turning briefly to FIGS. 4 and 5, it is to be understood that closure 20 is secured within boss 41 by means of a machine-performed crimping operation wherein outer wall 43 is compressed inwardly in a radial fashion such that the inside surface of outer wall 43 closely and continguously forms to the outside surface of recesses 26 and protruding portions 27. Additionally, the metal of outer wall 43 is formed inwardly into the offset portion existing as part of securing flange 24 and disposed below outer lip portion 25. Although this offset or clearance space is dimensionally very slight, it does provide an adequate securing lip to fully anchor the closure into the boss such that the closure may not be rotated relative to the boss (due in part to the nature of the recesses and protruding portions) nor pushed free of the boss by downward pressure which may be imparted during the engagement of the closure plug and tightening of that closure plug into the closure.

Referring to FIG. 5 in more detail, closure 20 is disposed within the raised, annular metal boss 41 of drum end 42. In order to initially hold closure 20 in place, a support plate 50 which is properly shouldered and offset is disposed beneath though contiguous with drum end 42 and includes a slightly raised interior annular portion 51 which supports securing flange 24. By designing the various interior and exterior surfaces of plate 50, the relationship between closure 20 and boss 41 can be self-aligning.

The machine utilized for crimping of the boss 41 in and around the serrations comprising recesses 26 and protruding portions 27 is generally represented by 52. Although all of the specific details of crimping machine 52 are not illustrated, machines of this type are believed to be well known in the art and only those portions which are unique and specialized for the present invention are detailed herein. In particular, crimping machine 52 includes a center holding and forming die 53 which is of annular shape and contoured along its lower surface so as to fit snugly up against upper wall 45 after forming inner wall 44 of boss 41. Disposed outwardly from center holding and forming die 53 are crimping members 54 which are designed and arranged to apply downward and inward forces to not only form outer wall 43 in and around recesses 26 and protruding portions 27, but as well as to tuck a portion of outer wall 43 beneath outer lip portion 25 as previously described.

Although the illustration of FIG. 5 shows closure 20 mounted into boss 41 with inner wall 44 already formed, it is to be understood that boss 41 undergoes two forming steps in order to create the shape which is illustrated in FIG. 4. The first step is to form the metal drum end with an axially extending outer wall and a radially extending upper wall. This is the configuration of boss 41 which is actually present at the time the closure is assembled to the boss, support plate 50 is moved into position and crimping machine 52 is operated. The first step or cycle of machine 52 is to move center holding and forming die 53 downwardly such that its center annular portion 55 forms inner wall 44. The degree and extent of such forming is of course controlled by the offset, outer annular ring portion 56 of die 53 which is moved into abutment against upper wall 45 and thus stops the advancement of die 53 at that point. Almost simultaneously with this boss forming operation, crimping members 54 actually impart a stretching action to boss 41 as they impart forces to pull the metal boss material down and under outer lip portion 25. As this occurs, the stretching of the upper and outer wall of the boss actually conforms the boss metal to the serrations of the closure.

As is intended to be illustrated by FIGS. 3 and 4, outer wall 43, after the crimping operation, is contiguous with the outer surface of recess 26 and protruding portions 27. Similarly, upper wall 45 is contiguous with top surface portion 31 and inner wall 44 is contiguous with inner securing wall 30. As should be understood, the use of synthetic material such as plastic for closure 20 may not be of sufficient strength to avoid closing in or thread distortion during the crimping operation. The substantial forces which are imparted to the outer wall 43 of the metal boss in order to form the metal of that wall into and around the various recesses and protruding portions has the effect of closing in the closure and distorting the threads unless the material for the closure is a high-strength and in turn high-cost synthetic material.

Although some type of plug or support can be temporarily added to the interior of the closure during the actual crimping operation, the forces which are induced by that crimping operation do not disappear. Consequently, once the temporary plug or back-up is removed, close-in and distortion will still occur. Additionally, if the drum and closure are subjected to a high-temperature environment, such as would be present during paint curing, distortion then becomes possible at that point. The solution offered by the present invention to reduce or eliminate close-in and distortion of the closure is to form boss 41 with an inner wall which continuously serves as back-up and support not only during the crimping operation, but as well during periods of use and during any other operations where distortion stresses may be induced into the closure.

The nature of the metal boss which is formed in the drum end, its generally cylindrical shape including inner wall, outer wall and the connecting upper wall provides an extremely strong and stress-resistant structure. Although the outer wall is deformable in and around the recesses and protruding portions, the inner wall and upper wall resist distortion during the crimping operation. By not enabling the inner wall or upper wall of the boss to distort or shift during the crimping operation, the closure is securely held and is in fact sandwiched between the inner and outer walls of the boss effectively causing all of the forces imparted during crimping to be directed solely to deformation of the outer wall into and around the recesses and protruding portions of the closure. Since virtually none of the crimping forces are transferred into distortion of the closure, the crimping operation is more efficient necessitating less force to achieve the objective. The back-up support for the closure which is provided by inner wall 44 continues to hold the closure in a nonstressed condition preventing close-in or distortion regardless of the environment to which the drum may be exposed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In combination:

a drum-like container end having a raised boss formed therein, said raised boss including an outer axially extending wall portion, an inner axially extending wall portion and a radially extending connecting wall portion joining said inner and outer wall portions together; and a synthetic material closure received by said container raised boss and having plug-engaging means internally disposed therein and an annular crimping flange including a first flange surface contiguous with said outer wall portion and a second flange surface contiguous with said inner wall portion.

2. The combination of claim 1 wherein said inner axially extending wall portion and said outer axially extending wall portion are of differing axial heights.

3. The combination of claim 2 wherein said first flange surface includes a plurality of serrations and said outer axial extending wall portion is formed to conform to said serrations.

4. The combination of claim 3 wherein said closure is fabricated as a homogeneous, unitary member from a nylon-based, glass-filled material.

5. The combination of claim 1 wherein said first flange surface includes a plurality of serrations and said outer axial extending wall portion is contoured to fit said serrations.

6. The combination of claim 1 wherein said closure is fabricated as a homogeneous, unitary member from a nylon-based, glass-filled material.

7. The combination of claim 1 wherein said inner axially extending wall portion and said outer axially extending wall portion are substantially concentric to one another.

8. In combination:

a synthetic material closure having a series of internal threads formed therein and outward of said threads a crimping flange, said crimping flange having an inside diameter support surface; and a container end having a formed metal boss disposed therein, said formed metal boss being suitably designed and arranged to receive said closure and including back-up support means cooperatively arranged with said support surface in order to substantially prevent distortion of said internal threads.

9. The combination of claim 8 wherein said formed metal boss includes an outer axially extending wall portion and substantially concentric therewith an inner, axially extending wall portion.

10. The combination of claim 8 wherein said back-up support means includes said inner, axially extending wall portion.

11. The combination of claim 8 wherein said crimping flange includes a series of exterior serrations.

* * * * *